US012708839B2

(12) United States Patent
Schlapik et al.

(10) Patent No.: US 12,708,839 B2
(45) Date of Patent: Aug. 18, 2026

(54) DUAL GEOMETRY HINGED MAGNETIC PUZZLES

(71) Applicant: Kevin D. Schlapik, Dania Beach, FL (US)

(72) Inventors: Kevin D. Schlapik, Fort Lauderdale, FL (US); Yu Sheng, Shantou (CN)

(73) Assignee: Kevin Schlapik, Dania Beach, FL (US)

( * ) Notice: Subject to any disclaimer, the term of this patent is extended or adjusted under 35 U.S.C. 154(b) by 266 days.

(21) Appl. No.: 18/356,598

(22) Filed: Jul. 21, 2023

(65) Prior Publication Data

US 2023/0356067 A1 Nov. 9, 2023

Related U.S. Application Data

(63) Continuation of application No. PCT/US2023/060406, filed on Jan. 10, 2023.

(60) Provisional application No. 63/298,718, filed on Jan. 12, 2022.

(51) Int. Cl.
*A63F 9/08* (2006.01)

(52) U.S. Cl.
CPC ..... *A63F 9/088* (2013.01)

(58) Field of Classification Search
CPC ..... A63F 9/088; A63F 2009/0884
See application file for complete search history.

(56) References Cited

U.S. PATENT DOCUMENTS 1,997,022 A 4/1935 Stalker
2,570,625 A 10/1951 Zimmerman et al.
2,839,841 A 6/1958 Berry
2,992,829 A * 7/1961 Hopkins ..... A63F 9/088 428/542.2
3,095,668 A 7/1963 Dorsett
3,254,440 A 6/1966 Duggar
3,618,954 A 11/1971 Murff
3,645,535 A 2/1972 Alexander
3,659,360 A 5/1972 Walter
(Continued)

FOREIGN PATENT DOCUMENTS

DE 4200184 A1 * 8/1992
DE 19617526 A1 5/1997
(Continued)

OTHER PUBLICATIONS

International Search Report and Written Opinion mailed on May 16, 2023, issued in the corresponding International Application No. PCT/US23/60406, filed on Jan. 10, 2023, 15 pages.

*Primary Examiner* — Eugene L Kim
(74) *Attorney, Agent, or Firm* — IPkey PLLC

(57) ABSTRACT

Dual geometry puzzles are formed of a continuous loop of polyhedrons connected by hinges. The polyhedrons include first type polyhedrons having a first geometry and second type polyhedrons having a different second geometry. Each of the polyhedrons includes at least one magnet disposed proximal to at least one face thereof. Eight of the twelve polyhedrons are the first type polyhedron, and four of the twelve polyhedrons are the second type polyhedron. The puzzles may be configurable between a first inverted configuration and a second inverted configuration. A first face of each of the first type polyhedrons may be congruent with a first face and a second face of each of the second type polyhedron.

26 Claims, 11 Drawing Sheets

(56) References Cited

U.S. PATENT DOCUMENTS

| | | | | |
|---|---|---|---|---|
| 3,662,486 | A | 5/1972 | Freedman | |
| 3,746,345 | A | 7/1973 | Palazzolo | |
| 3,831,503 | A | 8/1974 | Tranquillitsky | |
| 3,916,559 | A | 11/1975 | Flowerday | |
| 4,020,205 | A | 4/1977 | Haselbauer | |
| D246,544 | S | 11/1977 | Brinkley | |
| 4,063,725 | A | 12/1977 | Snyder | |
| D248,987 | S | 8/1978 | Paschal | |
| 4,142,321 | A | 3/1979 | Coppa | |
| 4,227,334 | A | 10/1980 | Hooker | |
| 4,258,479 | A | 3/1981 | Roane | |
| D264,361 | S | 5/1982 | Meffert | |
| 4,334,870 | A | 6/1982 | Roane | |
| 4,334,871 | A * | 6/1982 | Roane | A63H 33/046 434/211 |
| 4,377,916 | A | 3/1983 | Komiya | |
| 4,392,323 | A | 7/1983 | Rubik | |
| 4,484,406 | A | 11/1984 | Matsumoto et al. | |
| 4,722,712 | A | 2/1988 | Mckenna | |
| 4,875,681 | A * | 10/1989 | Ofir | A63F 9/088 446/119 |
| 4,886,273 | A | 12/1989 | Unger | |
| 4,993,989 | A | 2/1991 | Gidwani | |
| 5,009,625 | A | 4/1991 | Longuet-Higgins | |
| D321,671 | S | 11/1991 | Goonen | |
| D324,891 | S | 3/1992 | Vershaeve, Jr. et al. | |
| 5,108,100 | A | 4/1992 | Essebaggers et al. | |
| 5,192,077 | A | 3/1993 | Caicedo | |
| 5,193,809 | A | 3/1993 | Hrsel et al. | |
| 5,199,711 | A | 4/1993 | Pataki et al. | |
| 5,249,966 | A | 10/1993 | Hiigli | |
| 5,299,804 | A | 4/1994 | Stevens | |
| 5,322,284 | A | 6/1994 | El-Agamawi | |
| 5,338,034 | A | 8/1994 | Asch | |
| 5,429,966 | A | 7/1995 | Wu et al. | |
| D365,295 | S | 12/1995 | Kandampully | |
| 5,630,587 | A | 5/1997 | Zlotsky | |
| 5,651,715 | A | 7/1997 | Shedelbower | |
| 5,660,387 | A | 8/1997 | Stokes | |
| 5,746,638 | A | 5/1998 | Shiraishi | |
| 5,762,529 | A | 6/1998 | Nizza | |
| 6,017,220 | A | 1/2000 | Snelson | |
| 6,024,626 | A | 2/2000 | Mendelsohn | |
| 6,196,544 | B1 | 3/2001 | Rachofsky | |
| 6,257,574 | B1 | 7/2001 | Evans | |
| 6,264,199 | B1 | 7/2001 | Schaedel | |
| 6,386,541 | B1 | 5/2002 | Cornelius et al. | |
| 6,467,205 | B1 | 10/2002 | Flagg et al. | |
| D475,094 | S | 5/2003 | Ko | |
| 6,796,560 | B1 | 9/2004 | Cornelius et al. | |
| D617,850 | S | 6/2010 | Langin-Hooper | |
| 8,061,713 | B2 | 11/2011 | Cook | |
| 8,087,671 | B2 | 1/2012 | Houlis | |
| 8,157,608 | B1 | 4/2012 | Stapleton | |
| 9,662,592 | B2 | 5/2017 | Haughey et al. | |
| 10,569,185 | B2 | 2/2020 | Hoenigschmid | |
| 10,918,964 | B2 | 2/2021 | Hoenigschmid | |
| D984,551 | S * | 4/2023 | Schlapik | D21/478 |
| D989,190 | S * | 6/2023 | Schlapik | D21/478 |
| 11,697,058 | B1 * | 7/2023 | Hoenigschmid | A63H 33/046 273/155 |
| 2007/0037469 | A1 | 2/2007 | Yoon | |
| 2008/0224665 | A1 | 9/2008 | Matsumoto et al. | |
| 2008/0274665 | A1 | 11/2008 | Cheng | |
| 2010/0038850 | A1 | 2/2010 | Tenorio | |
| 2010/0087119 | A1 | 4/2010 | Vicentelli | |
| 2010/0120322 | A1 | 5/2010 | Vicentelli | |
| 2010/0225057 | A1 | 9/2010 | Akiyama et al. | |
| 2012/0164913 | A1 | 6/2012 | Pomeroy et al. | |
| 2014/0213139 | A1 | 7/2014 | Ferguson et al. | |
| 2014/0357151 | A1 | 12/2014 | Worley | |
| 2015/0065007 | A1 | 3/2015 | Klepper et al. | |
| 2016/0199749 | A1 | 7/2016 | Whittaker | |
| 2022/0047960 | A1 | 2/2022 | Hoenigschmid | |

FOREIGN PATENT DOCUMENTS

| | | | | |
|---|---|---|---|---|
| DE | 202014002837 | U | 6/2014 | |
| DE | 202014002837 | U1 * | 7/2014 | A63F 9/088 |
| FR | 1582965 | A | 10/1969 | |
| FR | 2614210 | A1 * | 10/1988 | |
| FR | 2669550 | A1 | 5/1992 | |
| GB | 588842 | A | 6/1947 | |
| GB | 2064844 | A | 6/1981 | |
| GB | 2107200 | A * | 4/1983 | A63F 9/088 |
| GB | 2108395 | A * | 5/1983 | A63F 9/001 |
| GB | 2353226 | A * | 2/2001 | A63F 9/088 |
| KR | 200454067 | Y1 | 6/2011 | |
| WO | WO-2004096393 | A2 * | 11/2004 | A63F 9/088 |
| WO | 2013097872 | A1 | 7/2013 | |
| WO | 2014038735 | A1 | 3/2014 | |
| WO | 2015141927 | A1 | 9/2015 | |
| WO | WO-2022130285 | A1 * | 6/2022 | |

* cited by examiner

208

| | |
|---|---|
| + | 1 |
| O | √(2) |
| Δ | 2 |
| □ | √(3) |

DUAL GEOMETRY HINGED MAGNETIC PUZZLES

This application is a continuation of International Application No. PCT/US23/60406, filed Jan. 10, 2023, which claims the benefit of U.S. Provisional Patent Application No. 63/298,718, filed Jan. 12, 2022, the entire disclosure of which is hereby incorporated by reference.

TECHNICAL FIELD

The present disclosure relates to the field of toys and puzzles.

BACKGROUND

Puzzles have enjoyed cross-generational appeal as games, toys, teaching aids, therapy devices, and the like. Such puzzles may be configured between different geometric configurations as shown in, e.g., UK Patent Application No. GB 2,107,200 to Asano and U.S. Pat. No. 6,264,199 B1 to Schaedel. As taught in the prior art, the properties of any particular polyhedral puzzle are highly specific to the geometry and hinging arrangements of that specific puzzle. For example, the folding puzzle taught in Schaedel teaches a folding puzzle consisting of twenty-four identical isosceles tetrahedron bodies, each being formed of four triangular faces having angles of approximately 70.53°, 54.74°, and 54.74°. The tetrahedrons are joined to each other at their base (longest) edges and can be manipulated into a rhombic dodecahedron in "many different ways." However, Schaedel does not teach any other geometry capable of achieving a rhombic dodecahedron in many different ways. Indeed, as one skilled in the art will appreciate, there are seemingly infinite different combinations of variables in such a puzzle, including: the number of faces and edges of the polyhedrons, the interior angles and edge lengths of the polyhedrons, the number of polyhedrons, whether all polyhedrons are identical or not, how the polyhedrons are ordered, the location of the hinges between the polyhedrons, and other variables. Moreover, due to such seemingly infinite combinations of variables and the unpredictable results from changes in the interrelated variables, even minor variations of one variable can alter the properties of the overall puzzle, often in ways that are detrimental to the functionality and appeal of the puzzle itself.

Accordingly, there is a need for new puzzles having different geometries and exciting new properties.

SUMMARY

The present disclosure provides puzzles having a number of solid polyhedral bodies hingedly joined in a continuous loop. By executing different move sequences, the puzzles can be manipulated into many different configurations of visual and tactile interest. For example, the polyhedrons are configured to be manipulated about a ring axis of the continuous loop (i.e., turning the puzzle inside out) and/or toggled about hinges (e.g., bridging strips) connecting adjacent polyhedrons. The specific geometry of the polyhedrons and the specific hinged relationships defined by the hinges enable the puzzles to be manipulated into numerous different geometric configurations and to be inverted (turned inside-out) in two different ways. Moreover, a plurality of magnets having complementary polarities are disposed throughout the puzzle. Advantageously, said magnets stabilize the puzzle in numerous configurations.

In an aspect, the present disclosure provides dual geometries puzzles, comprising: a continuous loop of polyhedrons hingedly connected by hinging means (e.g., hinges), wherein a first plurality of the polyhedrons are first type polyhedrons having a first geometry, and wherein a second plurality of the polyhedrons are second type polyhedrons having a different second geometry, wherein each of the polyhedrons comprises at least one magnet disposed proximal to at least one face thereof.

In another aspect, the present disclosure provides dual geometry puzzles, comprising: a continuous loop of polyhedrons connected by hinges, wherein a first plurality of the polyhedrons are first type polyhedrons having a first geometry, and wherein a second plurality of the polyhedrons are second type polyhedrons having a different second geometry, wherein each of the polyhedrons comprises at least one magnet disposed proximal to at least one face thereof. The continuous loop of polyhedrons may be configurable between a first inverted configuration and a second inverted configuration, wherein the first inverted configuration and the second inverted configuration are congruent parallelepipeds having an aperture disposed therethrough. All outermost surfaces of the first inverted configuration may be mutually exclusive from all outermost surfaces of the second configuration.

In any embodiment, the polyhedrons may consist of twelve polyhedrons, for example, wherein eight of the twelve polyhedrons are the first type or second type polyhedrons, and wherein four of the twelve polyhedrons are the second type or first type polyhedrons, respectively.

In any embodiment, the twelve polyhedrons may be connected by the hinges in the continuous loop in a repeating sequence, for example, consisting of one of the first type polyhedrons, one of the second type polyhedrons, and a second of the first type polyhedrons.

In any embodiment, each of the first type and second type polyhedrons may be tetrahedrons.

In any embodiment, each of the first type polyhedrons may comprise four right triangle faces.

In any embodiment, each of the first type and second type polyhedrons may have edge lengths which are either one unit, the square root of 2 units ($\sqrt{(2)}$ units), 2 units, or the square root of three units ($\sqrt{(3)}$ units).

In any embodiment, the continuous loop of polyhedrons may be configurable between a first inverted configuration and a second inverted configuration, wherein the first inverted configuration and the second inverted configuration are congruent parallelepipeds having an aperture disposed therethrough.

In any embodiment, all outermost surfaces of the first inverted configuration may be mutually exclusive from all outermost surfaces of the second configuration.

In any embodiment, a first face of each first type polyhedron may be congruent with a first face and a second face of each second type polyhedron.

In any embodiment, a fourth face of each first type polyhedron may be congruent with a third face and a fourth face of each second type polyhedron.

In any embodiment, each of the twelve polyhedrons may comprise at least one magnet disposed proximal to every face thereof.

In any embodiment, the at least one magnet of each polyhedron has an opposite polarity of the at least one magnet of each adjacent polyhedron of the continuous loop.

In any embodiment, each of the first type polyhedrons may be a tetrahedron with six edges, including two edges with an edge length of one unit, two edges with an edge length of the square root of 2 units (√(2) units), one edge with an edge length of 2 units, and one edge with an edge length of the square root of three units (√(3) units).

In any embodiment, each of the second type polyhedrons may be a tetrahedron with six edges, including two edges with an edge length of one unit, one edge with an edge length of the square root of two units (√(2) units), one edge with an edge length of 2 units, and two edges with an edge length of the square root of three units (√(3) units).

In any embodiment, any one or more of the foregoing features may be critical.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

The following disclosure describes hinged magnetic dual geometry puzzles (hereinafter referred to as puzzles for brevity) comprising hingedly connected polyhedrons, each of which has particular geometric characteristics. Further, each of the polyhedrons is hingedly connected to other polyhedrons of the puzzle and optionally has structural features which enable unique functionality and/or exhibit unique properties of the puzzle.

In particular, the puzzles have at least two different types of polyhedral bodies (i.e., having at least two different geometries), a characteristic which enables new and unique properties which individually and/or collectively enhance the appeal of such puzzles as teaching aids, therapy devices, and toys. As will be appreciated from the following description, such properties may include any one or more of:

1. The ability of the puzzle to be configured into a single, common, polyhedral shape in more than one way. Each configuration having this common polyhedral shape is called an "inverted configuration" because the puzzle can be turned inside out (or inverted) into that configuration. Restated, the polyhedral shape of each inverted configuration is congruent with polyhedral shape of each other inverted configuration. In some embodiments, the inverted configuration is a parallelepiped, e.g., a parallelepiped an aperture disposed therethrough, thus providing a "holy" shape.
2. the ability to achieve new configurations not previously achievable, such as the configurations shown in FIG. 1 and FIG. 7B-FIG. 7C
3. for each inverted configuration, the outermost surfaces of the puzzle differ from (e.g., are mutually exclusive from) the outermost surfaces of the puzzle in each other inverted configuration
4. for each inverted configuration, the outermost surfaces of the polyhedron have a different appearance and/or texture (surface treatment) from the outermost surfaces of at least one other congruent inverted configuration
5. geometric and magnetic compatibility with other puzzles enables the puzzles to be assembled with and/or coupled to other alike puzzles.

As used herein, the term "congruent" means that two geometric figures (such as two polyhedrons of a single puzzle, or such as the overall shape of two puzzles) are identical in shape and size. This includes the case when one of the geometric figures is a mirror image of the other.

The specific examples described herein are representative, not limiting, and it shall be appreciated that the present disclosure is not limited to the specific embodiments described. It shall further be appreciated that any embodiment may include any one or more of the features described below in any combination.

Figure 1:
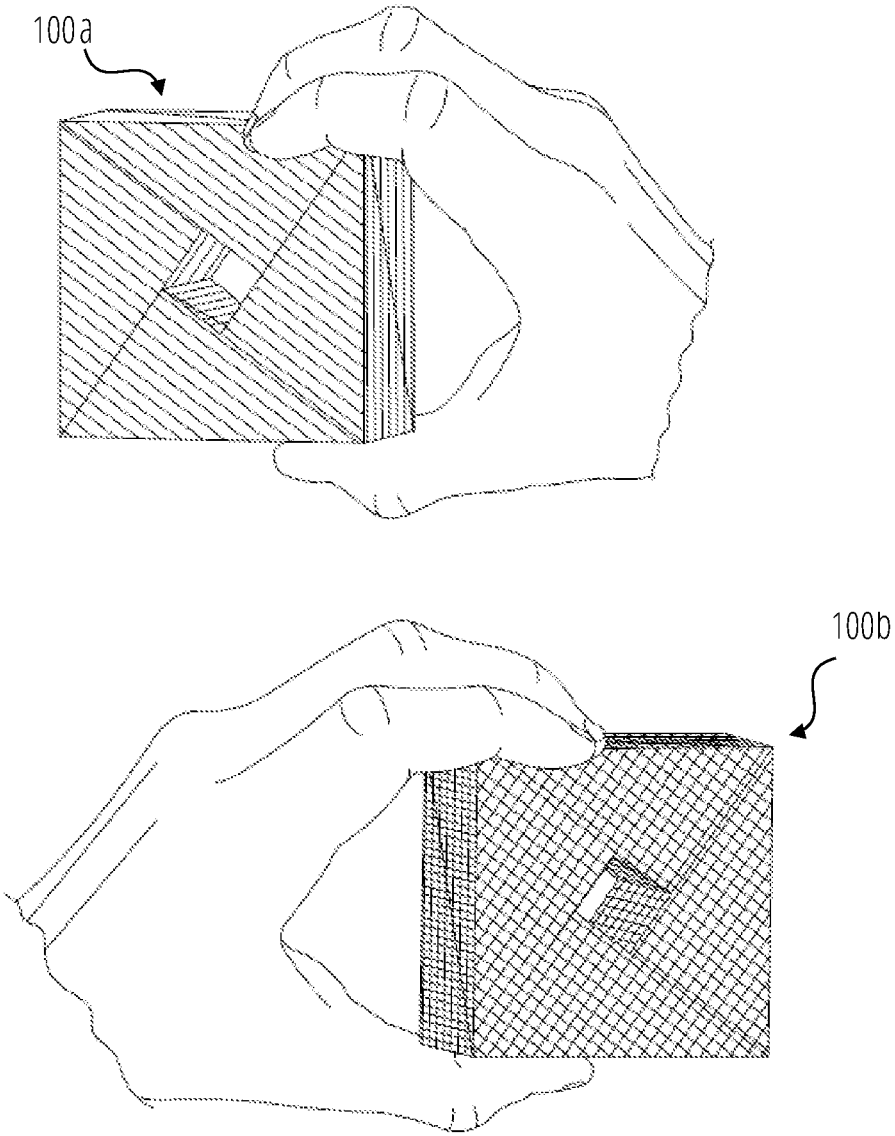
FIG. 1 illustrates a puzzle in two inverted configurations, according to a representative embodiment of the present disclosure.

FIG. 1 illustrates a dual geometry puzzle 100 according to a representative embodiment of the present disclosure. As will be detailed below, the puzzle 100 includes a plurality of magnet-containing polyhedrons which are coupled together in a continuous loop by hinges as described with respect to FIG. 2 and FIG. 3A-FIG. 3B. The puzzle 100 is unique because it comprises two different types of polyhedrons and magnets which stabilize the puzzle 100 in numerous configurations such as those shown in FIG. 1, FIG. 4A-FIG. 4C, FIG. 7A-FIG. 7C, and FIG. 8D.

In particular, FIG. 1 illustrates the same puzzle 100 at two different points in time in order to exhibit its unique "dual inversion" property, i.e., its ability to be manipulated into two inverted configurations. As used herein, the term "inverted configuration" means a configuration of the puzzle which has an overall shape that is congruent with another configuration of the puzzle (i.e., another inverted configuration), but which has outermost surfaces which are mutually exclusive from the outermost surfaces of that other configuration. Restated, the puzzle 100 can be configured into a single polyhedral shape in two different ways having mutually exclusive outermost exclusive surfaces.

For example, the puzzle 100 at a first time $t_1$ (indicated as puzzle 100*a*) is configured into a first inverted configuration having a parallelepiped shape with first outermost surfaces (indicated by parallel hatching). By comparison, the puzzle 100 at a second time $t_2$ (indicated as puzzle 100*b*) is configured into a second inverted configuration having a parallelepiped shape which is congruent with the first configuration and which presents second outermost surfaces (indicated by cross hatching).

The first outermost surfaces and the second outermost surfaces of the puzzle 100 in the first and second inverted configurations (i.e., at times $t_1$ and $t_2$) are mutually exclusive. In some embodiments, the outermost surfaces of each inverted configuration can be provided with different surface treatments (e.g., graphics and/or textures), for example to increase the appeal of the puzzle. For example, different surface treatments can indicate to the user when they have achieved different inverted configurations.

Another unique property is that the inverted configurations shown in FIG. 1 are parallelepipeds having an aperture therethrough. This configuration is balanced and symmetrical, thus providing a configuration that is visually appealing, suitable for packaging, and not heretofore achievable with known magnetically stabilized puzzles.

Additional unique properties of the puzzle 100 will be evident from following description.

Figure 2:
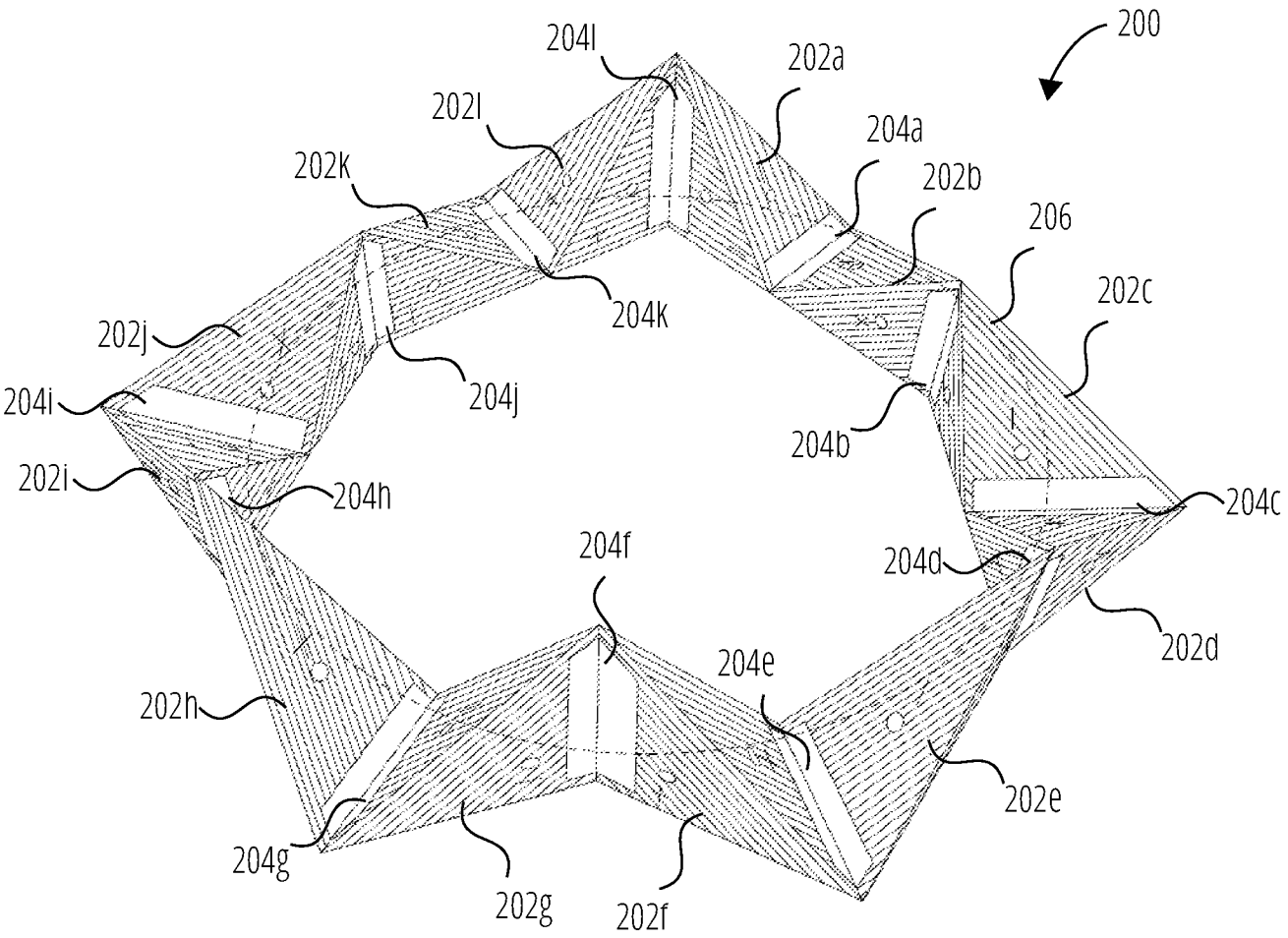
FIG. 2 illustrates a perspective view of a puzzle according to a representative embodiment of the present disclosure.

Referring to FIG. 2, the characteristics of a puzzle 200 will now be described. The puzzle 200 has the same geometry as the puzzle 100 and therefore can achieve the inverted configurations shown in FIG. 1.

Puzzle 200 includes a plurality of polyhedral modules or polyhedrons 202*a*-2021 which are coupled together in a continuous loop about ring axis 206. Each of the polyhedrons is a solid body, optionally having a cavity formed therein, and may be formed from a thermoplastic polymer (e.g., PLA) or other rigid material. To clarify, the polyhedrons described herein are not limited to bodies which are completely solid. In some embodiments, one or more of the polyhedrons may be hollow (i.e., having a cavity therein) and may have one or more cut-outs from its volume.

The polyhedrons 202*a*-2021 are hingedly coupled together by hinges (e.g., bridging strips 204*a*-2041) in an end-to-end configuration. The bridging strips 204*a*-1 flexibly join adjacent polyhedrons 202*a*-2021, enabling reversible toggling of the joined bodies such that different faces abut each other.

As described below, each polyhedron of the polyhedrons 202*a*-2021 is provided with at least one magnet; together, the magnets stabilize the puzzle 200 in various configurations of visual and tactile appeal, such as the parallelepiped inverted configurations of FIG. 1 and the configurations of FIG. 7A-FIG. 7C.

By manipulating the polyhedrons 202*a*-2021, the puzzle 200 may be magnetically stabilized into numerous different configurations. FIG. 6A-FIG. 7C illustrate representative configurations, including the parallelepiped inverted configurations, a cubic hexahedron, a polyhedron with two hingedly connected parallelepipeds, a hexahedron with a triangular profile, various regular polyhedrons, irregular polyhedrons, convex polyhedrons, concave polyhedrons, and other polyhedron types.

To achieve the different configurations, the polyhedrons 202*a*-2021 may be manipulated in different sequences comprising one or more of the following steps or moves:

- rotating one or more polyhedrons 202*a*-2021 about the ring axis 206 (which tends to turn the puzzle 200 inside out);
- toggling one or more polyhedrons 202*a*-2021 about the bridging strips 204*a*-2041 such that different faces of polyhedrons 202*a*-2021 abut each other; or
- translating one or more polyhedrons 202*a*-2021 relative to each other.

Unlike known puzzles, the puzzles of the present disclosure comprise a continuous loop of at least two different polyhedrons 202*a*-2021. A polyhedron may be defined as different from another polyhedron according to any one or more of the following conditions:

- two polyhedrons have at least one differently-sized face and/or edge;
- two polyhedrons have a different number of faces, edges, and/or vertices;
- two polyhedrons are geometrically similar, but differently-sized faces and/or edges;
- two polyhedrons are not congruent;
- two polyhedrons have a different volume;
- two polyhedrons have a different number of isosceles triangular faces;
- two polyhedrons have a different number of congruent triangular faces;
- two polyhedrons have a common polyhedral shape (e.g., both are tetrahedrons) in addition to any one or more of the above criteria.

Advantageously, the utilization of two or more different polyhedrons enables the puzzle 200 to be manipulated into new and interesting configurations such as those shown in FIG. 1 and FIG. 6A-FIG. 7C and to achieve dual inversion functionality.

It shall be appreciated that the utilization of different polyhedrons complicates the selection of geometry for the individual polyhedrons. Practically infinite combinations of different polyhedrons could be used, in theory. Due to different edge lengths and vertices, almost all of the possible combinations of different polyhedrons could not produce the harmonious configurations achievable with the puzzle 200. For example, the parallelepiped shape with an aperture therethrough of FIG. 1 could not be achieved if all the polyhedrons were congruent, or if the individual polyhedrons possessed most geometries other than those described below in FIG. 3A-FIG. 3B. Moreover, the puzzle 200 could not achieve dual inversion functionality with that same parallelepiped inverted configuration with almost any other geometry. Further still, the combination of configurations shown in FIG. 7A-FIG. 7C could not be achieved with most other polyhedral combinations due to mismatching faces and edges. As described below, although the puzzle 200 includes more than one different type of polyhedron, the different types of polyhedron nevertheless share some common features, for example common edge lengths and certain congruent faces. These common properties enable the overall puzzle to achieve the configurations described herein.

Thus, a key technical problem overcome by the puzzles described herein is the selection and ordered arrangement of magnetized polyhedrons having two or more different geometries in order to achieve a puzzle which can achieve appealing magnetically-stabilized configurations and dual inversion functionality. It shall be appreciated that a puzzle with polyhedrons having different geometries presents the challenge of mismatched edges and faces (i.e., different edge lengths and face shapes), which makes it all the more difficult to achieve a puzzle capable of achieving appealing magnetically stabilized configurations.

In the illustrated embodiment, puzzle 200 is formed of a continuous loop of twelve hingedly connected polyhedrons 202*a*-2021, wherein each polyhedron is a tetrahedron. Each tetrahedron is hingedly connected to two adjacent tetrahedrons along the ring axis 206 by two of the bridging strips 204*a*-2041.

Figure 3A:
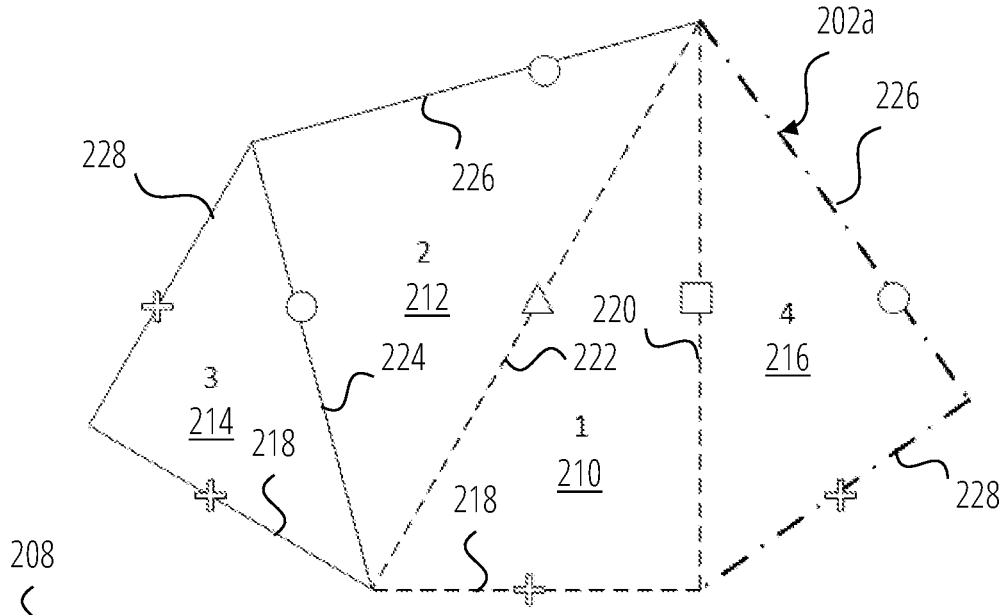
FIG. 3A is a schematic representation of the geometry of a first type polyhedron of the puzzle of FIG. 2.

Eight of the twelve polyhedrons 202*a, c, d, f, g, i, j, l*, are a first type of tetrahedron having a first geometry described in FIG. 3A. The remaining four of the polyhedrons 202*b, e, h, k* are a second type of tetrahedron having a different second geometry described in FIG. 3B. As used herein, two or more polyhedrons may be of a single type of polyhedron (i.e., either first type or second type) if they are congruent with each other, notwithstanding any difference in surface treatment. For example, two mirror image polyhedrons are congruent, and therefore can both be a first type or a second type polyhedron.

The polyhedrons 202*a*-2021 are hingedly connected in a repeating sequence consisting of one of the first type, one of the second type, and one of the first type. Restated, if the first type of polyhedrons are represented as type "A," and the second type of polyhedrons are represented as type "B," then the polyhedron 202*a*-1 are connected in the following sequence, beginning with tetrahedron 202*a*: A, B, A, A, B, A, A, B, A, A, B, A. Accordingly, the puzzle 200 includes (e.g., consists of) eight of the first type polyhedrons and four of the second type polyhedrons.

Figure 3B:
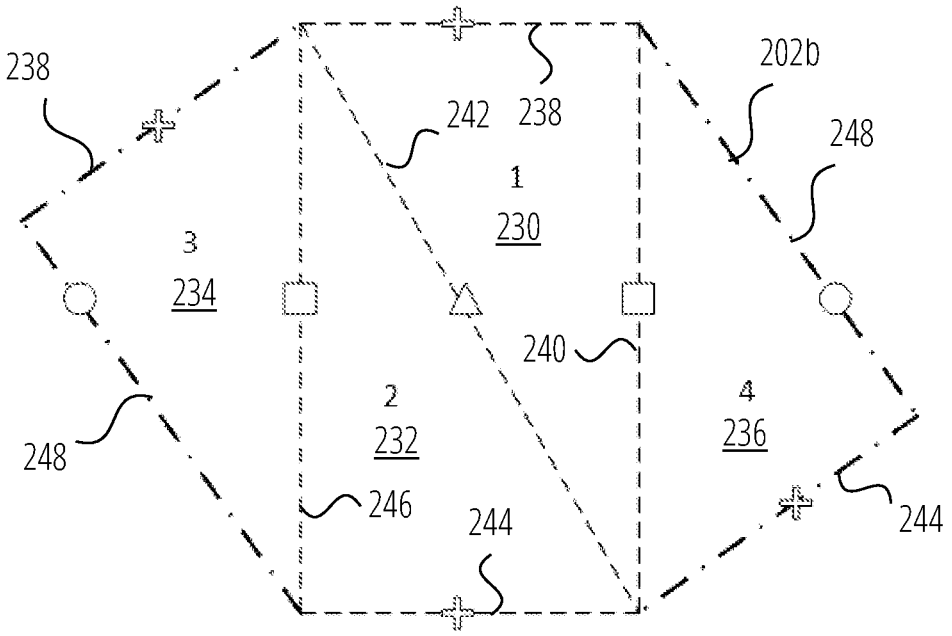
FIG. 3B is a schematic representation of the geometry of a second type polyhedron of the puzzle of FIG. 2.

FIG. 3A and FIG. 3B show the geometries of the first type and second type of polyhedrons 202*a*-2021 of puzzle 200, respectively. The meanings of FIGS. 3A and 3B are both governed by the legend 208, which describes the relationship between different side lengths of the first type and second type of polyhedron. Sides labeled with the plus sign "+" have a length of one unit, which may be scaled up or down in different embodiments. Regardless of the numerical value of the unit ("+"), the relative relationships between the different sides remain constant between different embodiments. Restated, regardless of the numerical value of the unit length "+," sides labeled with "○" have a length equal to √(2)(unit length) (i.e., the square root of two times the unit length), sides labeled with A have a side length equal to 2(unit length), and sides labeled with "□" have a side length equal to √(3)(unit length) (i.e., the square root of three times the unit length).

FIG. 3A schematically represents the geometry of first type polyhedron 202*a*, which is congruent with polyhedron 202*c, d, f, g, i, j, l*. As shown, polyhedron 202*a* is a tetrahedron with four faces 210, 212, 214, 216, and six edges 218, 220, 222, 224, 226, 228. The relative lengths of each edge are dictated by legend 208. As a result of the edge length relationships of legend 208, all four faces 210, 212, 214, and 216 are right triangles, and second face 212 and third face 214 are isosceles triangles.

In the illustrated embodiment, each of the first type polyhedrons is a tetrahedron with six edges, including two edges with an edge length of one unit (edges 218 and 228), two edges with an edge length of √(2) units (edges 224 and 226), one edge with an edge length of 2 units (edge 222), and one edge with an edge length of √(3) units (edge 220).

FIG. 3B schematically represents the geometry of second type polyhedron 202*b*, which is congruent with polyhedrons 202*e, h, k*. As shown, polyhedron 202*b* is a tetrahedron with four faces 230, 232, 234, 236, and six edges 238, 240, 242, 244, 246, 248. The relative lengths of each edge are dictated by legend 208. As a result of the edge length relationships of legend 208, all four faces 230, 232, 234, 236 are right triangles. Moreover, the first face 230 and second face 232 are congruent, and the third face 234 and fourth face 236 are congruent.

In the illustrated embodiment, each of the second type polyhedrons is a tetrahedron with six edges, including two edges with an edge length of one unit (edges 238 and 244), one edge with an edge length of √(2) units (the square root of two units) (edge 248), one edge with an edge length of 2 units (edge 242), and two edges with an edge length of √(3) units (the square root of three units) (edges 240 and 246).

Comparing FIG. 3A with FIG. 3B, it is evident that first face 210 of the first type polyhedron 202*a* is congruent with the first face 230 and second face 232 of the second type polyhedron 202*b*. This congruence, together with the other edge relationships of the two types of tetrahedron, as well as the ordered sequence described above of the first type and second type polyhedrons in the continuous loop, and the placement of the hinges, enables the first face 210 of one of the first type of polyhedrons to abut either the first face 230 or the second face 232 of one of the second type of polyhedrons, thereby forming a configuration having three orthogonal faces. Such a configuration having three orthogonal faces is useful for the construction of various parallelepiped configurations, such as the parallelepiped inverted configuration of FIG. 1 and the cubic hexahedron of FIG. 7A, and the hingedly connected parallelepiped of FIG. 7B.

Figure 4A:
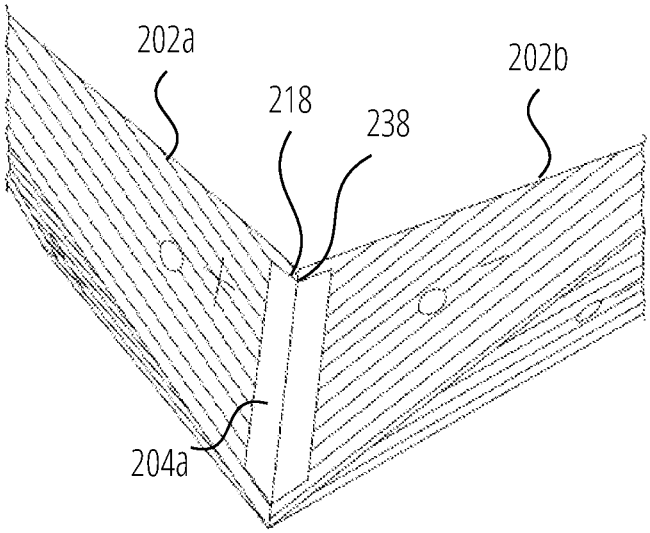
FIG. 4A illustrates a perspective view of a first hinging configuration of the puzzle of FIG. 2.
Figure 4B:
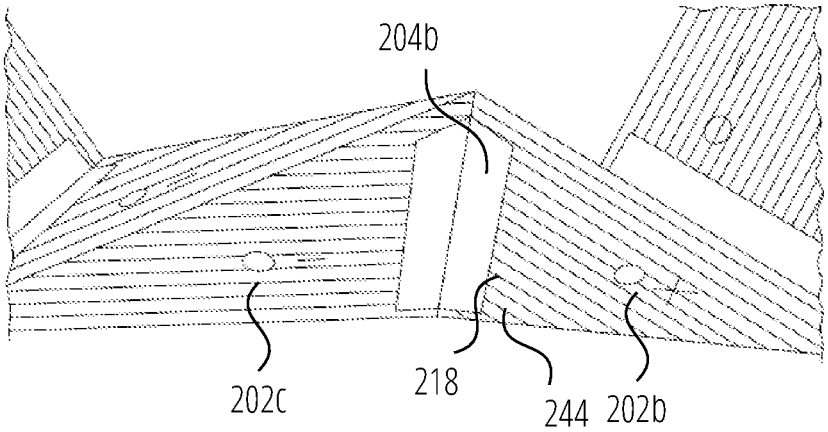
FIG. 4B illustrates a perspective view of a second hinging configuration of the puzzle of FIG. 2.
Figure 4C:
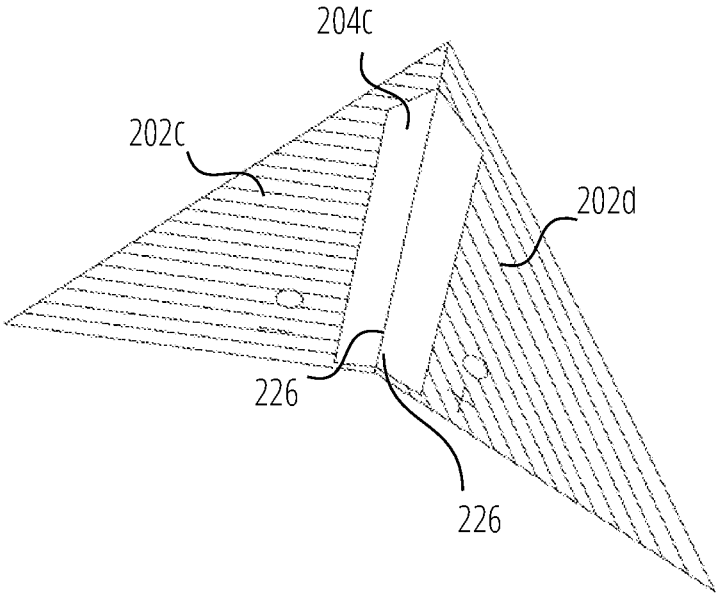
FIG. 4C illustrates a perspective view of a third hinging configuration of the puzzle of FIG. 2.

Turning now to FIG. 4A-FIG. 4C, details of representative hinge placements between polyhedrons of the puzzle 200 will be described. The illustrated embodiment includes bridging strips disposed at three different types of locations (the different edges identified below correspond to the diagrams of FIG. 3A-FIG. 3B):

- between the first edge of the first type of tetrahedron and the first edge of an adjacent second type of tetrahedron (see FIG. 4A, showing the bridging strip 204*a* extending from first edge 218 of (first type) polyhedron 202*a* to first edge 238 of (second type) polyhedron 202*b*);
- between the first edge of the first type of tetrahedron and the fourth edge of an adjacent second type of tetrahedron (see FIG. 4B, showing the bridging strip 204*b* extending from the first edge 218 of (first type) polyhedron 202*c* to the fourth edge 244 of (second type) polyhedron 202*b*); and
- between the fifth edge of the first type of tetrahedron and the fifth edge of an adjacent first type of tetrahedron (see FIG. 4C, showing the bridging strip 204*c* extending from the fifth edge 226 of (first type) polyhedron 202*c* to fifth edge 226 of adjacent (first type) polyhedron 202*d*).

In some embodiments such as the puzzle 200 of FIG. 2, the foregoing hinge types are arranged about the puzzle 200 in the ordered sequence introduced above. In some embodiments, the bridging strips may be adhesive-type, decal-type, or tape-type bridging strips adhesively joined with adjacent faces of the polyhedrons. However, the bridging strips are not so limited. In some embodiments, the bridging strips are internal-type bridging strips extending through an interior volume of each polyhedron.

Notwithstanding the representative hinges shown in FIG. 2-FIG. 4C, the hinges may take many different forms. In some embodiments, such as shown in FIG. 2, each of the hinges is a decal or sticker applied to the faces of at least two adjacent polyhedrons such that the hinge extends from one of the polyhedrons directly to another polyhedrons. Whereas each hinge of FIG. 2 connects two adjacent polyhedrons, in some embodiments, one or more hinges may connect more than two polyhedrons. For example, in some embodiments, a single continuous decal may be applied to more than two polyhedrons. Representative hinges of this configuration are detailed in U.S. Pat. Nos. 10,569,185 and 10,918,964 to Hoenigschmid, which are herein incorporated by reference in their entireties.

In other embodiments, the hinges are formed integrally with the polyhedral modules (e.g., living hinges) and extend directly from one of the modules to an adjacent module. In such embodiments, the hinges may be formed as a flexible polymer strip of a same or similar material as the outer shell of the polyhedral module. Representative hinges of this configuration are detailed in U.S. Pat. No. 11,358,070 to Aberg, which is herein incorporated by reference in its entirety.

In still other embodiments, the hinges are formed as one or more internal flexible connection strips (e.g., of a thin flexible polymer or textile) extending between adjacent modules and configured to be anchored within internal cavities of adjacent polyhedrons. Representative hinges of this configuration are detailed in PCT Publication No. WO 2022/130285 to Hoenigschmid, which is herein incorporated by reference in its entirety.

In any embodiment, more than one hinge may extend between adjacent edges of adjacent modules. The foregoing hinge structures are representative, not limiting.

Figure 5:
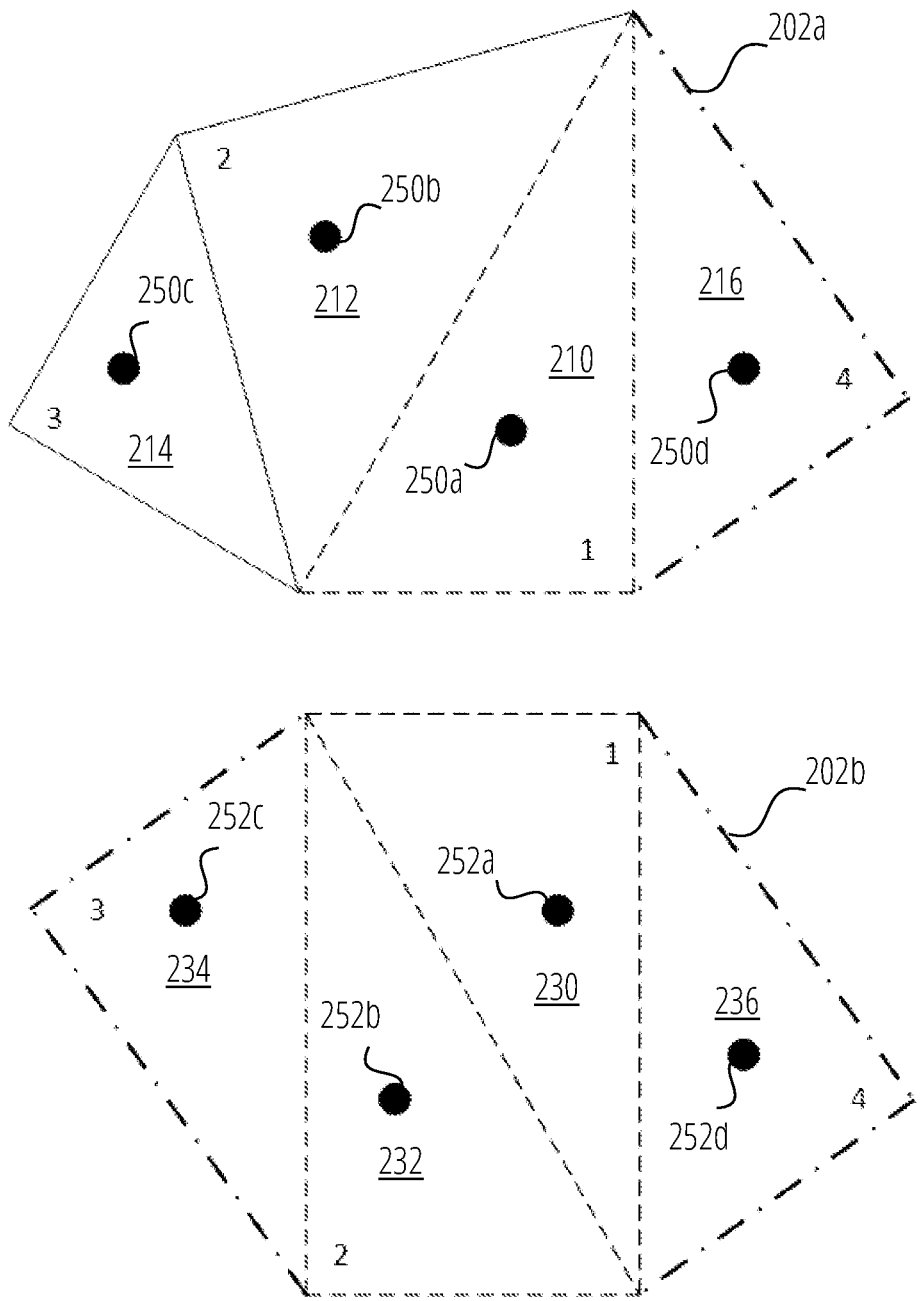
FIG. 5 is a schematic representation of one representative placement of magnets in the first type and second type polyhedrons of the puzzle of FIG. 2.
Figure 6D:
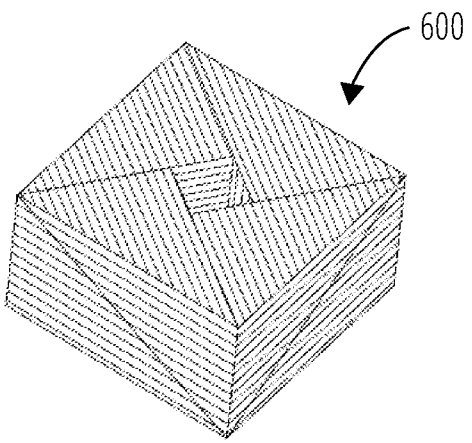
FIG. 6D illustrates an upper right perspective view thereof.
Figure 6C:
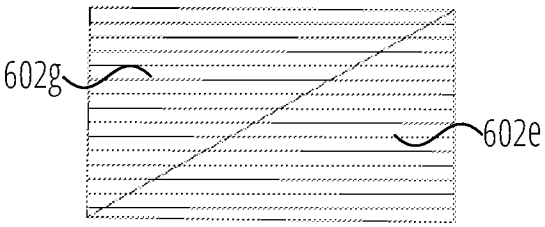
FIG. 6C illustrates a right elevation view thereof.
Figure 6A:
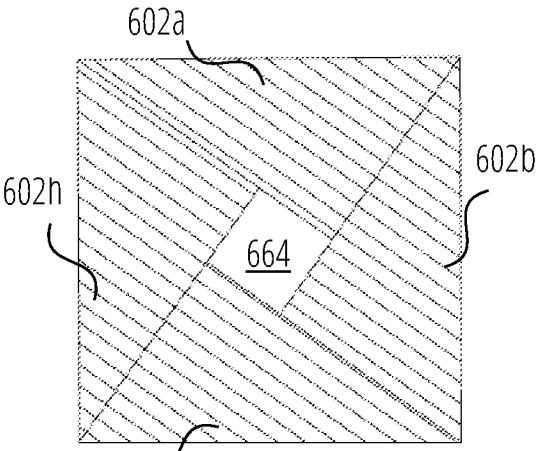
FIG. 6A illustrates a top plan view of a puzzle in an inverted configuration, according to a representative embodiment of the present disclosure.
Figure 6B:
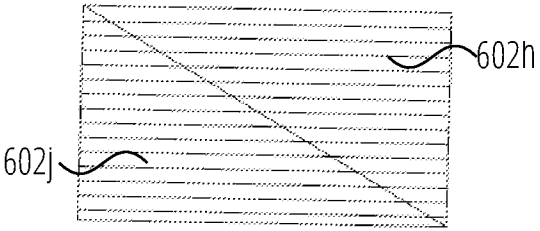
FIG. 6B illustrates a front elevation view thereof.
Figure 7A:
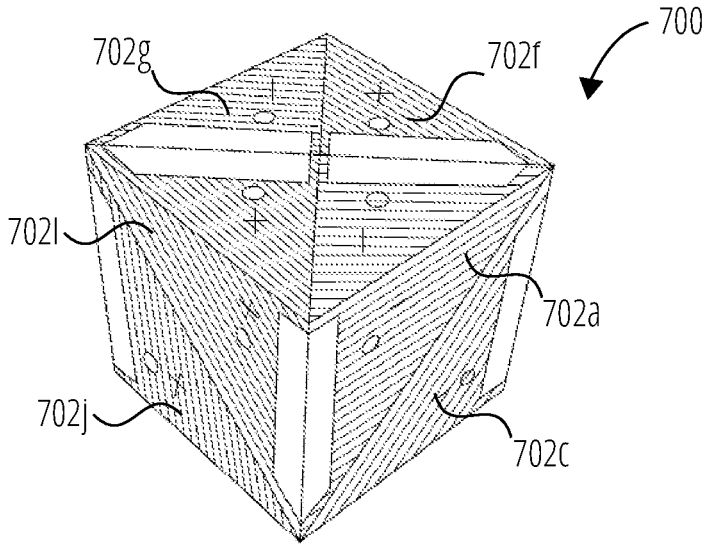
FIG. 7A illustrates a perspective view of a puzzle according to a representative embodiment of the present disclosure, in a second configuration.
Figure 7B:
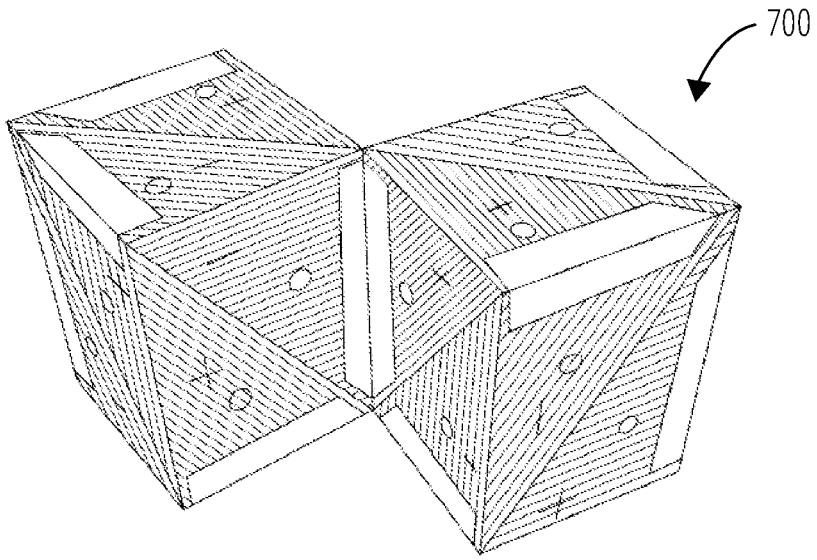
FIG. 7B illustrates a perspective view of the puzzle of FIG. 7A in a third configuration.
Figure 7C:
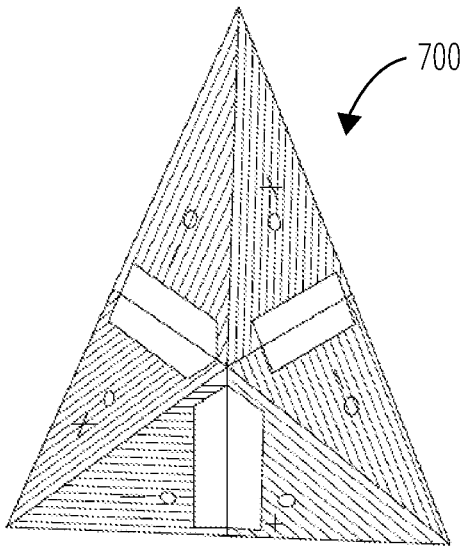
FIG. 7C illustrates a perspective view of the puzzle of FIG. 7A in a fourth configuration.

Referring to FIG. 5, some or all of the polyhedrons of the puzzle 200 include magnets which stabilize the puzzle 200 in any one or more of the configurations shown and described herein, including the inverted configuration of FIG. 1 and the configurations of FIG. 7A-FIG. 7C. In particular, at least one magnet is provided on each polyhedron at a location and with a polarity selected to magnetically couple with at least one magnet of an opposite polarity positioned on another polyhedron, e.g., when the puzzle 200 is manipulated into the different configurations.

In the illustrated embodiment, each face of each polyhedron includes at least one magnet disposed adjacent thereto. That is, each first type polyhedron (e.g., tetrahedron 202*a*) includes at least one magnet 250*a* disposed adjacent to the first face 210, at least one magnet 250*b* disposed adjacent to the second face 212, at least one magnet 250*c* disposed adjacent to the third face 214, and at least one magnet 250*d* disposed adjacent to the fourth face 216.

Similarly, each second type polyhedron (e.g., tetrahedron 202*b*) includes at least one magnet 252*a* disposed adjacent to the first face 230, at least one magnet 252*b* disposed adjacent to the second face 232, at least one magnet 252*c* disposed adjacent to the third face 234, and at least one magnet 252*d* disposed adjacent to the fourth face 236.

In the illustrated embodiment, each magnet is embedded in each face, e.g., in a recess formed in the face itself (either on the outer surface or inner surface). In other embodiments, each magnet may be disposed within an interior cavity of each polyhedron and positioned sufficiently near the relevant face such that the magnetic field of the magnet extends through said face. For example, in some embodiments, each magnet may be held within in a groove, slot, and/or track disposed within the cavity. In some embodiments, one or more of the magnets may be positioned within a cradle, such as a cradle disposed near a vertex of the edges of the polyhedron, such that the magnetic field from the magnet extends through more than one face of the polyhedron. Representative structures for securing magnets in polyhedrons are described in U.S. Pat. Nos. 10,569,185 and 10,918,964 and U.S. Patent Publication No. US 2022/0047960 to Hoenigschmid, which are hereby incorporated by reference in their entireties.

The magnets 250*a-d* and 252*a-d* are positioned and polarized to magnetically couple with other magnets of the puzzle 200. For example, in any embodiment, any one or more of the following magnet pairs may be positioned and polarized to magnetically couple with each other (i.e., the two magnets may have opposite polarities):

- Magnet 250*a* positioned adjacent to the first face 210 of the first type of polyhedron and magnet 252*a* positioned adjacent to the first face 230 of a second type of polyhedron (e.g., a hingedly coupled second type of polyhedron).
- Magnet 250*a* positioned adjacent to first face 210 of the first type of polyhedron and magnet 252*b* positioned adjacent to second face 232 of the second type of polyhedron (e.g., a hingedly coupled second type polyhedron).
- Magnets 250*b* positioned adjacent to second faces 212 of adjacent first type polyhedrons (e.g., hingedly coupled first type polyhedrons).
- Magnets 250*c* positioned adjacent to third faces 214 of adjacent first type polyhedrons (e.g., hingedly coupled first type polyhedrons).
- Magnets 250*d* positioned adjacent to fourth faces 216 of first type polyhedrons.
- Magnets 252*c* positioned adjacent to third faces 234 of second type polyhedrons.
- Magnets 252*d* positioned adjacent to fourth faces 236 of second type polyhedrons.

To facilitate magnetic coupling as described above, in some embodiments, every first type polyhedron has alike-positioned magnets 250*a-d*, and every second type polyhedron has alike-positioned magnets 252*a-d*. In some embodiments (such as shown in FIG. 2), each polyhedron has magnets of a single polarity (i.e., positive or negative), and the polarity alternates between successive polyhedrons in the continuous loop, regardless of whether the polyhedrons are first type or second type. Restated, in some embodiments, the polarity of all magnets in one polyhedron is either positive or negative, and the polarity of all magnets in the next successive polyhedron in the continuous loop is the opposite polarity, i.e., either negative or positive, respectively.

In some embodiments, each of the first type polyhedron and each second type polyhedron has four magnets. However, in some embodiments, one or more of the first type polyhedrons and/or one or more of the second type polyhedrons has less than four magnets, for example one, two, or three magnets. Advantageously, including fewer magnets may reduce the production cost of the puzzle, albeit at the cost of reduced magnetic stabilization.

FIG. 6A-FIG. 6D illustrate views of a puzzle 600 in one of the inverted configurations shown in FIG. 1. The puzzle 600 is the same as the puzzle 100 of FIG. 1 and which comprises polyhedrons in the same hingedly coupled arrangement and having the same geometry as shown in FIG. 2 and FIG. 3A-FIG. 3B. In particular, FIG. 6A-FIG. 6D show a top plan view, a front elevation view, a right elevation view, and an upper perspective view, respectively of the parallelepiped inverted configuration shown with respect to puzzle 100*a* in FIG. 1. As shown, the puzzle 600 is magnetically stabilized in a parallelepiped configuration having a square aperture 664 extending entirely therethrough. A magnetically stabilized puzzle having such a shape was previously unknown. Accordingly, the geometry of the puzzle 600, together with the magnets disposed in the polyhedrons, impart valuable new functionality heretofore not achievable.

The aperture 664 results from the different geometries between the first type polyhedrons and the second type polyhedrons. For example, polyhedrons 602*a* and 602*b* are coupled together and have different geometries. That is, polyhedron 602*a* is a first type polyhedron as shown in FIG. 3A, whereas 602*b* is a second type polyhedron as shown in FIG. 3B. Likewise for polyhedrons 602*g* and 602*h*. The different edge lengths between the first type and second type polyhedrons creates the aperture 664.

FIG. 7A-FIG. 7C show additional magnetically stabilized configurations achievable with a puzzle 700 which has the same geometry as the puzzle 100 of FIG. 1 and which comprises polyhedrons in the same hingedly coupled arrangement and having the same geometry as shown in FIG. 2 and FIG. 3A-FIG. 3B.

One interesting property of the puzzle 100 is that all such configurations have a common volume. The configurations shown in FIG. 7A-FIG. 7C are representative of interesting configurations achievable with the dual-geometry puzzle 700, but are not limiting. Numerous additional magnetically stabilized configurations can be achieved with the puzzle 100.

FIG. 7A shows a cubic hexahedron or cubic parallelepiped polyhedron achievable with the puzzle 100. Given its uniform and compact dimensions, the cubic hexahedron configuration is ideal for packaging and shipment of the puzzle 100. Interestingly, the puzzle 700 can achieve the cubic hexahedron of FIG. 7A despite comprising polyhedrons having at least two different geometries because in the configuration shown in FIG. 7A, only first type polyhedrons are presented. Restated, in the configuration of FIG. 7A, the outer surfaces are entirely comprised of congruent first type polyhedrons 702*a*, 702*c*, 702*d*, 702*f*, 702*g*, 702*i*, 702*j*, 702*l*.

FIG. 7B shows a magnetically stabilized polyhedron with two congruent hingedly connected parallelepipeds, which is achievable with the puzzle 100.

FIG. 7C is another magnetically stabilized hexahedron, which has a triangular profile. This hexahedron can be achieved in a magnetically stabilized position with two sequential moves from the cubic hexahedron of FIG. 7A.

FIG. 8A-FIG. 8D illustrate one representative method of manipulating a puzzle 800 of the present disclosure into the parallelepiped inverted configuration shown in FIG. 1 (particularly, with respect to puzzle 100*a*). The puzzle 800 has the same geometry as the puzzle 100 of FIG. 1 and which comprises polyhedrons in the same hingedly coupled arrangement and having the same geometry as shown in FIG. 2 and FIG. 3A-FIG. 3B.

To further orient the user, the polyhedrons of the puzzle 800 correspond to the polyhedrons of FIG. 2. That is, polyhedron 802*a* of FIG. 8A corresponds to polyhedron 202*a* of FIG. 2, polyhedron 802*b* of FIG. 8B corresponds to polyhedron 202*b*, and so on.

The following description provides a general method for configuring the puzzle 800 into a parallelepiped inverted configuration, i.e., that shown in FIG. 1 and FIG. 6A-FIG. 6D. The skilled user will appreciate that by modifying the method as described below, a congruent inverted configuration can be achieved which presents mutually exclusive outermost surfaces.

It shall be appreciated that the illustrated method is representative and not limiting. It may be possible to achieve the inverted configuration shown in FIG. 8D utilizing fewer than all of the steps illustrated, and/or by combining certain steps.

In an optional first step shown in FIG. 2, the puzzle 800 is placed in the illustrated open loop configuration.

Figure 8A:
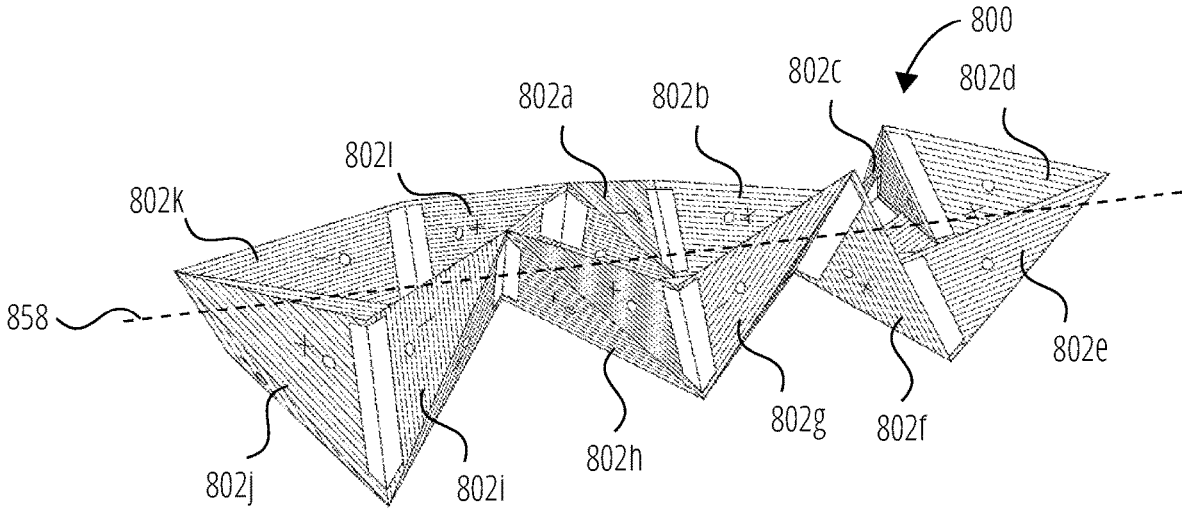
FIG. 8A illustrates a first step in a method of manipulating a puzzle into an inverted configuration, according to a representative embodiment of the present disclosure.

Next, as shown in FIG. 8A, opposed polyhedrons having different geometries are positioned adjacent to each other (and magnetically stabilized to each other) such that the puzzle 800 is oriented in a linear configuration generally characterized by longitudinal axis 858. For example, polyhedron 802*j* (a first type polyhedron) is positioned adjacent to polyhedron 802*k* (a second type polyhedron), polyhedron 802*a* (a first type polyhedron) is positioned adjacent to polyhedron 802*h* (a second type polyhedron), and so on.

Figure 8B:
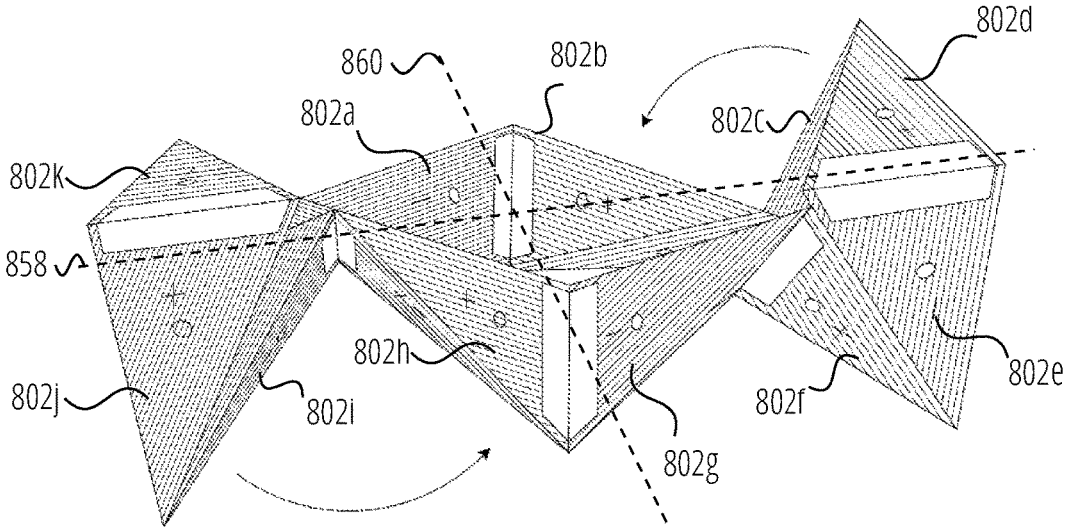
FIG. 8B illustrates a second step in the method of manipulating the puzzle of FIG. 8A into the inverted configuration.
Figure 8C:
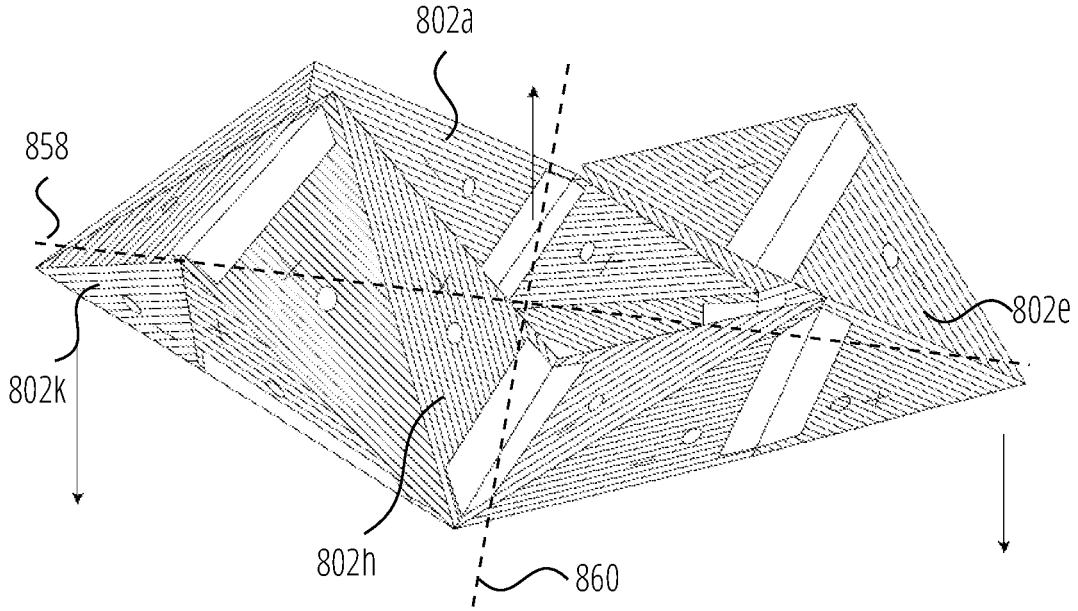
FIG. 8C illustrates a third step in the method of manipulating the puzzle of FIG. 8A into the inverted configuration.
Figure 8D:
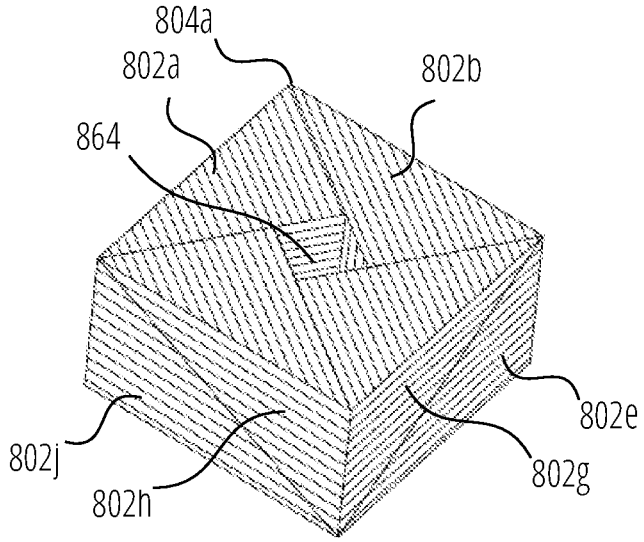
FIG. 8D illustrates a fourth step in the method of manipulating the puzzle of FIG. 8A into the inverted configuration.

Here, it is noted that the user can adjust the foregoing step to change which outermost faces are presented in the resulting parallelepiped configuration of FIG. 8D. That is, by placing the puzzle 800 in the configuration shown in FIG. 8A with polyhedron 802*a* placed adjacent to polyhedron 802*h*, the puzzle 800 will present first outermost surfaces when manipulated into the parallelepiped of FIG. 8D. However, by instead placing polyhedron 8021 (a first type polyhedron) adjacent to polyhedron 802*e* (a second type polyhedron), the puzzle 800 will present second outermost surfaces when manipulated into the parallelepiped of FIG. 8D, the second outermost surfaces being mutually exclusive of the first outermost surfaces. With such a modification, the user can therefore achieve the two parallelepiped inverted configurations, thus realizing the dual inversion functionality of the puzzle 800. If the first outermost surfaces have a different appearance than the second outermost surfaces, the puzzle 800 can thus achieve the same shape with two different appearances (as shown in FIG. 1).

Returning to FIG. 8A, the end polyhedrons are then rotated inwardly upon the corresponding penultimate polyhedrons to which the end polyhedrons are hingedly connected. In the embodiment shown, polyhedrons 802*j*, 802*k* are rotated inwardly upon polyhedrons 802*i*, 8021, respectively. Similarly, polyhedrons 802*d*, 802*e* are rotated inwardly upon polyhedrons 802*c*, 802*f*, respectively. This results in the configuration shown in FIG. 8B.

Referring now to FIG. 8B, in this intermediate configuration, puzzle 800 is generally characterized by the longitudinal axis 858 and a perpendicular latitudinal axis 860. On each side of the longitudinal axis 858, the puzzle 800 has three apparent points (a central point and two outer points) comprising vertexes of one or more polyhedrons. The polyhedrons are then manipulated such that, on a first side of the longitudinal axis 858, the central point meets the outer point on a first side of the latitudinal axis 860. For example, the points of polyhedrons 802*b*, 802*c* are brought together in a first "quadrant" of axes 858, 860. The polyhedrons are further manipulated such that, on the second side of the longitudinal axis 858 (opposite to the first side), the central point meets the outer point on the second side of the latitudinal axis 860 (opposite to the first side). For example, the point of polyhedrons 802*h*, 802*i* are brought together in a second "quadrant" diagonal from the first quadrant. This results in the configuration shown in FIG. 8C.

Referring now to FIG. 8C, a central portion of the puzzle 800 (located where the axes 858, 860 intersect) is lifted upward while outermost points are rotated downward. For example, polyhedrons 802*a* and 802*h* may be lifted upwards at the same time as the points formed by polyhedrons 802*e*, 802*k* are rotated downwardly. Due to the geometry of the puzzle 800, the motion will eventually and naturally cause polyhedrons 802*a*, 802*h* to rotate away from each other in opposite directions along latitudinal axis 860. Consequently, the puzzle 800 achieves the parallelepiped inverted configuration of FIG. 8D.

FIG. 8D shows the parallelepiped inverted configuration resulting from the foregoing steps. The configuration of FIG.

8D is the same as that shown in FIG. 1 and FIG. 6A-FIG. 6D. As shown, the puzzle 800 has an aperture 864 therethrough. The aperture 864 is the consequence of the different geometries between the first type polyhedrons and the second type polyhedrons. For example, polyhedrons 802*a* and 802*b* are coupled together at hinge 804*a* and have different geometries. That is, polyhedron 802*a* is a first type polyhedron as shown in FIG. 3A, whereas polyhedron 802*b* is a second type polyhedron as shown in FIG. 3B. Likewise for polyhedrons 802*g* and 802*h*. The different edge lengths between the first type and second type polyhedrons thus creates the aperture 864.

The foregoing features, taken in combination, impart a number of unique features to the puzzles which enhance its appeal as a puzzle, a toy, and/or a teaching aid for learning geometry and other mathematics concepts. As one example, the hinged coupling between adjacent polyhedrons enable the puzzle 200 to be turned inside-out about ring axis 206. The hinged coupling in a continuous loop also enables rapid manipulation between various configurations without losing the individual polyhedrons.

The specific geometry, ordered arrangement, and positioning of the magnetized polyhedrons enable the puzzles to attain many magnetically stabilized configurations of visual and tactile appeal, including but not limited to the configurations shown in FIG. 1, FIG. 6A-FIG. 6D, FIG. 7A-FIG. 7C, and FIG. 8D. Said configurations exhibit unique forms of symmetry, and may be rapidly reorganized into the cube configuration of FIG. 7A, e.g., for convenient packaging, storage, and carry. In particular, the use of two different types of polyhedrons, with the particular geometries defined in FIG. 3A and FIG. 3B is new and nonobvious.

Finally, the magnets are positioned and polarized in particular configurations that stabilize the puzzles in all major configurations, imparting a pleasing solid feeling of quality.

It shall be appreciated that the foregoing advantages follow from the individual features and the unobvious combination of said features.

Representative embodiments of the invention can be implemented in many different forms and are not limited to the implementations described herein. On the contrary, the purpose of providing these embodiments is to make the disclosure of the present disclosure more thorough and comprehensive.

It should be noted that when an element is considered to be "connected" to another element, it may be directly connected to the other element or there may be a centered element at the same time. The terms "upper," "lower," "side," "vertical", "horizontal", "left", "right" and similar expressions used herein are for illustrative purposes only.

Unless otherwise defined, all technical and scientific terms used herein have the same meaning as commonly understood by those skilled in the technical field of the present disclosure. The terminology used in the description of the present disclosure herein is only for the purpose of describing specific embodiments and is not intended to limit the present disclosure. The term "and/or" as used herein includes any and all combinations of one or more related listed items.

What is claimed is:

1. A dual geometry puzzle, comprising:

a continuous loop of twelve polyhedrons connected by hinges, wherein eight of the twelve polyhedrons are a first type polyhedron having a first geometry, and wherein four of the twelve polyhedrons are a second type polyhedron having a different second geometry, wherein each of the twelve polyhedrons comprises at least one magnet disposed proximal to at least one face thereof; and wherein the continuous loop of polyhedrons is configurable between a first inverted configuration and a second inverted configuration, wherein the first inverted configuration and the second inverted configuration are congruent parallelepipeds having an aperture disposed therethrough.

2. The dual geometry puzzle of claim 1, wherein all outermost surfaces of the first inverted configuration are mutually exclusive from all outermost surfaces of the second configuration.

3. The dual geometry puzzle of claim 1, wherein the twelve polyhedrons are connected by the hinges in the continuous loop in a repeating sequence of one of the first type polyhedrons, one of the second type polyhedrons, and a second of the first type polyhedrons.

4. The dual geometry puzzle of claim 1, wherein each of the first type polyhedrons and the second type polyhedrons are tetrahedrons.

5. The dual geometry puzzle of claim 1, wherein each of the first type polyhedrons comprises four right triangle faces.

6. The dual geometry puzzle of claim 1, wherein each of the first type polyhedrons and the second type polyhedrons have only edge lengths which are either one unit, the square root of 2 units ($\sqrt{(2)}$ units), 2 units, or the square roots of three units ($\sqrt{(3)}$ units).

7. The dual geometry puzzle of claim 1, wherein a first face of each of the first type polyhedrons is congruent with a first face and a second face of each of the second type polyhedrons.

8. The dual geometry puzzle of claim 7, wherein a fourth face of each of the first type polyhedrons is congruent with a third face and a fourth face of each of the second type polyhedrons.

9. The dual geometry puzzle of claim 1, wherein each of the twelve polyhedrons comprises at least one magnet disposed proximal to every face thereof.

10. The dual geometry puzzle of claim 1, wherein each of the first type polyhedrons is a tetrahedron with six edges, including two edges with an edge length of one unit, two edges with an edge length of the square root of 2 units ($\sqrt{(2)}$ units), one edge with an edge length of 2 units, and one edge with an edge length of the square root of 3 units ($\sqrt{(3)}$ units).

11. The dual geometry puzzle of claim 10, wherein each of the second type polyhedrons is a tetrahedron with six edges, including two edges with an edge length of one unit, one edge with an edge length of the square root of 2 units ($\sqrt{(2)}$ units), one edge with an edge length of 2 units, and two edges with an edge length of the square root of 3 units ($\sqrt{(3)}$ units).

12. The dual geometry puzzle of claim 3, wherein a first face of each of the first type polyhedrons is congruent with a first face and a second face of each of the second type polyhedrons.

13. The dual geometry puzzle of claim 12, wherein each of the first type polyhedrons is a tetrahedron with six edges, including two edges with an edge length of one unit, two edges with an edge length of the square root of 2 units ($\sqrt{(2)}$ units), one edge with an edge length of 2 units, and one edge with an edge length of the square root of 3 units ($\sqrt{(3)}$ units).

14. A dual geometry puzzle, comprising:

a continuous loop of twelve polyhedrons connected by hinges, wherein eight of the twelve polyhedrons are a first type polyhedron having a first geometry, and wherein four of the twelve polyhedrons are a second type polyhedron having a different second geometry;

wherein a first face of each of the first type polyhedrons is congruent with a first face and a second face of each of the second type polyhedrons; and wherein the continuous loop of polyhedrons is configurable between a first inverted configuration and a second inverted configuration, wherein the first inverted configuration and the second inverted configuration are congruent parallelepipeds having an aperture disposed therethrough.

15. The dual geometry puzzle of claim 14, wherein a fourth face of each of the first type polyhedrons is congruent with a third face and a fourth face of each of the second type polyhedrons.

16. The dual geometry puzzle of claim 15, wherein the twelve polyhedrons are connected by the hinges in the continuous loop in a repeating sequence of one of the first type polyhedrons, one of the second type polyhedrons, and a second of the first type polyhedrons.

17. The dual geometry puzzle of claim 14, wherein the twelve polyhedrons are connected by the hinges in the continuous loop in a repeating sequence of one of the first type polyhedrons, one of the second type polyhedrons, and a second of the first type polyhedrons.

18. The dual geometry puzzle of claim 17, wherein each of the first type polyhedrons and the second type polyhedrons have only edge lengths which are either one unit, the square root of 2 units (√(2) units), 2 units, or the square roots of three units (√(3) units).

19. The dual geometry puzzle of claim 17, wherein each of the first type polyhedrons is a tetrahedron with six edges, including two edges with an edge length of one unit, two edges with an edge length of the square root of 2 units (√(2) units), one edge with an edge length of 2 units, and one edge with an edge length of the square root of 3 units (√(3) units).

20. The dual geometry puzzle of claim 14, wherein a fourth face of each of the first type polyhedrons is congruent with a third face and a fourth face of each of the second type polyhedrons, wherein each of the first type polyhedrons and the second type polyhedrons have edge lengths which are either one unit, the square root of 2 units (√(2) units), 2 units, or the square roots of three units (√(3) units).

21. The dual geometry puzzle of claim 14, wherein each of the first type polyhedrons is a tetrahedron with six edges, including two edges with an edge length of one unit, two edges with an edge length of the square root of 2 units (√(2) units), one edge with an edge length of 2 units, and one edge with an edge length of the square root of 3 units (√(3) units).

22. The dual geometry puzzle of claim 21, wherein each of the second type polyhedrons is a tetrahedron with six edges, including two edges with an edge length of one unit, one edge with an edge length of the square root of 2 units (√(2) units), one edge with an edge length of 2 units, and two edges with an edge length of the square root of 3 units (√(3) units).

23. The dual geometry puzzle of claim 14, wherein all outermost surfaces of the first inverted configuration are mutually exclusive from all outermost surfaces of the second configuration.

24. The dual geometry puzzle of claim 23, wherein the twelve polyhedrons are connected by the hinges in the continuous loop in a repeating sequence of one of the first type polyhedrons, one of the second type polyhedrons, and a second of the first type polyhedrons.

25. The dual geometry puzzle of claim 14, wherein each of the first type polyhedrons and the second type polyhedrons are tetrahedrons.

26. The dual geometry puzzle of claim 14, wherein each of the first type polyhedrons comprises four right triangle faces.

* * * * *